United States Patent [19]

Butterfield et al.

[11] 4,353,508

[45] Oct. 12, 1982

[54] NOZZLE WITH PRE-ORIFICE METERING RESTRICTION

[75] Inventors: Ted Butterfield, Naperville; Lyle J. Emory, Darien; Daniel Filicicchia, Aurora, all of Ill.

[73] Assignee: Spraying Systems Company, Wheaton, Ill.

[21] Appl. No.: 205,276

[22] Filed: Nov. 10, 1980

[51] Int. Cl.[3] ..... B05B 1/02

[52] U.S. Cl. ..... 239/590.3; 239/598

[58] Field of Search ..... 239/461, 498–500, 239/504, 505, 516, 518, 519, 569, 570, 589, 590–590.5, 596, 602, 597, 598; 138/37, 39, 40, 42, 44

[56] References Cited

U.S. PATENT DOCUMENTS

| | | | |
|---|---|---|---|
| 325,459 | 9/1885 | Taylor | 138/42 X |
| 1,005,722 | 10/1911 | Leeming | 239/590.3 |
| 1,684,575 | 9/1928 | Carrell | 239/504 X |
| 2,560,279 | 7/1951 | Curtis | 239/590.5 |
| 2,573,982 | 11/1951 | Dfeldt | 239/590.3 X |
| 2,829,874 | 4/1958 | Freeman | 239/590.3 X |
| 3,078,916 | 2/1963 | Loveland | 239/596 X |
| 3,186,646 | 6/1965 | Kennedy et al. | 239/596 X |
| 3,684,176 | 8/1972 | Hruby | 239/590 X |
| 3,894,688 | 7/1975 | Reeder | 239/570 X |

FOREIGN PATENT DOCUMENTS

| | | | |
|---|---|---|---|
| 548859 | 11/1957 | Canada | 239/590 |
| 760018 | 10/1956 | United Kingdom | 239/499 |

*Primary Examiner*—Johnny D. Cherry

*Attorney, Agent, or Firm*—McWilliams, Mann & Zummer

[57] ABSTRACT

This invention relates to a nozzle having a restriction in the form of an insert comprised of a pre-metering orifice in the nozzle that causes the emerging stream to flare out and impinge on the nozzle side walls and create turbulence to flood the nozzle and achieve a predetermined spray pattern. The premetering insert is formed to provide a non-uniform orifice length and is installed immediately ahead of the nozzle to reduce the velocity of the stream without disrupting the spraying performance of the nozzle and one or both parts are made from a plastic material such as nylon.

11 Claims, 14 Drawing Figures

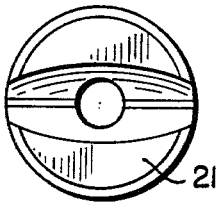
FIG. 2
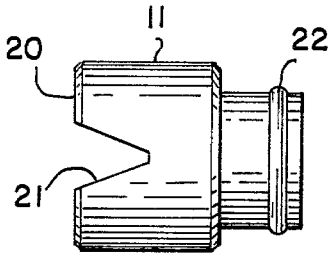
FIG. 3
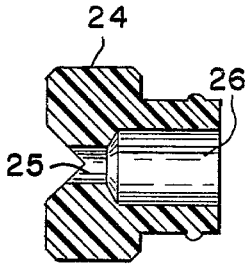
FIG. 4
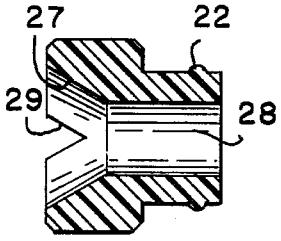
FIG. 5
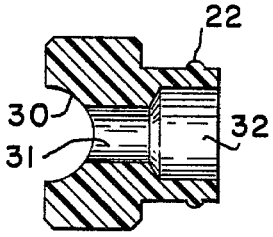
FIG. 6
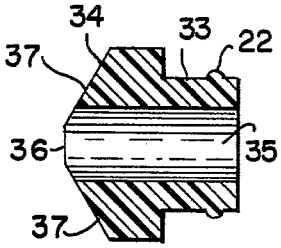
FIG. 7
FIG. 1
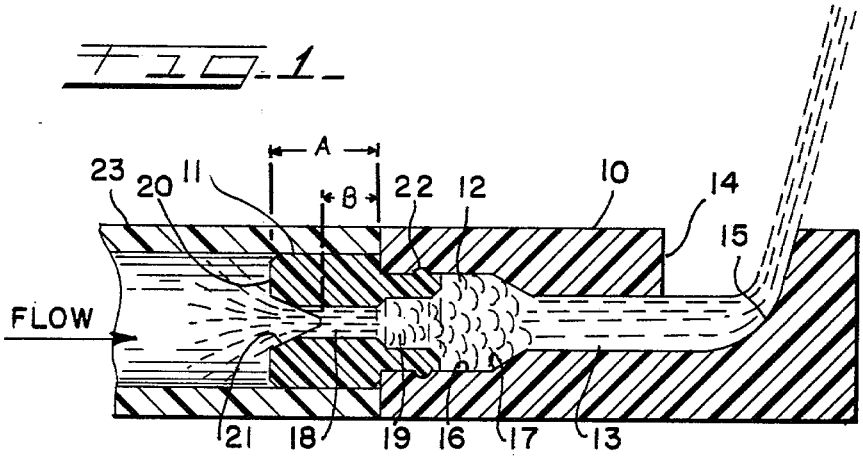

NOZZLE WITH PRE-ORIFICE METERING RESTRICTION

BACKGROUND OF THE INVENTION

1. Field of the Invention

This invention relates to spray nozzles suitable for use in creating spray patterns according to prescribed conditions and especially for handling strong solutions such as found in industry and including insecticides which normally result in erosion of metal nozzles such as those made of brass, or the like.

2. Description of the Prior Art

Heretofore, metal nozzles have been utilized with metering orifices which have been used in the upstream side of the spray nozzles to reduce the pressure and the flow to the nozzle. A common form of such restrictions consisted of a flat washer, or disc, having a round hole in the center, which was of a size to provide the desired restriction in accordance with the requirements of specified conditions to be met by the nozzle. The round center hole permitted maximum flow through the restriction consistent with the size of the hole and the flow issued through the restriction as a high velocity stream such that the desired spray performance of the associated nozzle was disturbed.

Ordinarily, when such a conventional orifice plate is used in a spray system, the flow through the orifice issues as a high velocity stream and this velocity is relative to the differential pressure across the orifice. When this high velocity stream impinges on the orifice of the nozzle because of the location of the orifice plate relative to the nozzle, this high velocity stream does not allow the orifice to flood, or fill and striking the nozzle orifice, disturbs the spray performance of the nozzle and frequently it is necessary to provide additional piping in ordr to maintain a minimum distance between the nozzle and orifice plate. Nozzles of this type usually have been made of metal such as brass, or the like.

An example of this condition is found in the industry relating to irrigation of farm fields, where a system of spray nozzles on a distributor pipe rotates about a central pivot. The nozzle nearest to this central pivot point is closest to the supply pump and requires the least flow and the lowest pressure. Efforts to compensate for this condition involved the use of nozzles having small orifice diameters as a means to control the flow through the nozzle closest to the pivot point but the spray issuing from these nozzles are finely atomized due to the higher pressure and consequently was adversely affected by wind conditions and also tended to cause the nozzle to clog. Under these conditions, a nozzle having a larger capacity was necessary and this was used in conjunction with a conventional metering orifice upstream of the nozzle to control the flow and reduce the pressure on the nozzle and produce a spray containing larger droplets. These conventional orifice plates were made of a size proportioned in accordance with the nozzle used and the spray desired and it was necessary to maintain a minimum spacing between the orifice plate and the nozzle orifice in an effort to avoid disturbance of the spray pattern discharged from the orifice.

SUMMARY OF THE INVENTION

This invention provides a pre-metering orifice adapted to be utilized immediately in advance of the nozzle without disruption of the spray pattern issuing from the nozzle. That is obtained by providing a metering device having a non-uniform orifice length which causes an emerging stream to issue from the metering orifice and flare, or spread out and impinge on the surrounding walls internally of the nozzle. This causes the development of turbulence within the nozzle which floods the nozzle orifice whereby a spray pattern issuing from the nozzle is obtained in accordance with a desired performance of the spray as determined by the discharge surface of the nozzle. The non-uniform length of the pre-metering orifice as disclosed herein, is obtained by intersecting the entrance opening of the passage leading to the orifice with a formed slot across the face of the pre-metering insert element at the upstream side of the insert. The pre-metering insert is installed immediately in advance of the spray nozzle and eliminates any need for additional piping since the pre-metering device does not require a critical spacing of the pre-metering orifice and the nozzle orifice.

DESCRIPTION OF THE DRAWINGS

The foregoing and other and more specific purposes of the invention are attained by the spray nozzle and pre-metering device illustrated in the accompanying drawings wherein FIG. 1 is a longitudinal sectional view through a spray nozzle and associated pre-metering orifice insert, wherein the nozzle and or orifice may be made from nylon;

FIG. 2 is an end elevational view of the pre-metering orifice insert;

FIG. 3 is a side elevational view of the entrance end of the insert;

FIGS. 4 through 11 are cross sectional views through respectively modified forms of the invention.

DESCRIPTION OF PREFERRED EMBODIMENT

Figure 8:
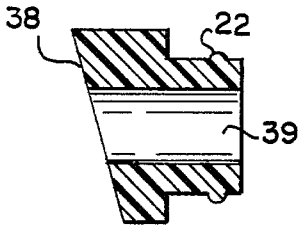

The spray nozzle and/or the pre-metering orifice of this invention may be made from a plastic material such as nylon, which is resistant to the erosion problem as well as corrosion found to affect metal nozzles such as those made from brass, or the like and particularly found to be objectionable in the field related for farm use where insecticides were used in the farm spraying procedures and which were found to erode, or corrode the spray nozzles that were made from metal and particularly such nozzles that were made from brass. The present nozzle however, is made from nylon and includes a pre-metering orifice also made of nylon and is constructed to obtain the desired spray pattern from the nozzle in accordance with conditions prescribed for attaining the performance desired while using insecticide sprays. However, stainless metal might be utilized in certain installations and perform satisfactorily.

It should be noted that this pre-metering orifice member is provided with an orifice of non-uniform length obtained by intersecting the entrance opening of the orifice with a slot which extends across the face of the entrance area.

As shown in FIG. 1, the invention is comprised of a spray nozzle 10 and an associated pre-metering orifice insert 11 mounted in the upstream end of the nozzle member. The nozzle member includes an internal turbulence chamber 12 communicating directly with a central passage 13 leading to a generally lateral discharge orifice outlet 14. Where the passage 13 changes direction from a longitudinal path to the generally laterally directed discharge path, the passage is provided with a rounded, or curved, surface 15 to direct the stream issuing from the nozzle outwardly in a controlled spray pattern. The nozzle orifice starts with the passage 13 and is continuous from the turbulence chamber 12 to the outlet 14.

The pre-metering orifice insert 11 is mounted immediately in advance of the nozzle 10 and is disposed to discharge directly into the turbulence chamber 12 so that the stream issuing from this orifice is directed into the chamber 12 where it impinges on the internal walls 16 and 17 of the turbulence chamber to create the turbulence and flood the nozzle orifice 13/14 and thence form the controlled spray pattern issuing from the nozzle. The orifice insert 11 includes a central passage 18 leading to an enlarged chamber 19 which opens directly into the turbulence chamber 12. The central passage thus extends entirely through the pre-metering orifice member 11 from the upstream face 20 of the member to the open inner end discharging into the turbulence chamber. The upstream face 20 of the orifice member 11 is provided with a formed V-shaped slot 21 intersecting the entrance opening of the central passage 18, as best shown in FIG. 3. This slot 21 is seen in end elevation in FIG. 2 and as best shown in FIG. 1 creates the non-uniform length of passage 18 which comprises the pre-metering orifice. It will be seen that the walls of the orifice 18 vary in length from the dimension "A" to that represented by the dimension "B" so that it is by this means that the non-uniformity is obtained and it should be noted that this difference in length is not just the two dimensions "A" and "B" but is a continuous variation around the orifice so that the walls of the orifice 18 are of continuously variable dimension so that it can truly be said that the orifice is of non-uniform length.

The pre-metering orifice insert 11 is secured in the spray nozzle 10 by means of a snap fit, as indicated at 22 in FIG. 1 and the assembled nozzle and orifice insert are operatively associated with a supply conduit 23 which is engaged over the insert outer surface as shown in FIG. 1. This manner of securing the elements 10 and 11 together is facilitated by the parts being made from suitable plastic material such as nylon.

DESCRIPTION OF MODIFIED EMBODIMENTS

FIG. 4: This form of the pre-metering orifice comprises a member 24 that is quite similar to the form of the device shown in FIG. 1 but the central passage 25 is of shorter length and the chamber 26 is of greater length and capacity than the chamber 19 of FIG. 1. Otherwise, the V-shaped slot intersecting the entrance opening of the orifice is substantially like the previously described arrangement and provides the orifice of non-uniform dimension lengthwise.

FIG. 5: This pre-metering insert differs from the previously described forms by utilizing a conical inlet opening 27 leading to the central passage 28 and having a V-shaped groove 29 intersecting the conical opening on the face of the insert disposed toward the entering stream. The central passage 28 in this form comprises a continuous chamber of uniform diameter and does not include a separate chamber comparable to the chamber 19 in FIG. 1. However, the non-uniform length of the orifice is present as a result of the V-shaped groove 29.

FIG. 6: This design for the pre-metering orifice insert differs primarily from the original insert of FIG. 1 by reason of the shape of the slot 30 on the upstream face of the insert which intersects the opening to the orifice passage 31, as before, but is of rounded inner contour, or concave, which will also effect the non-uniform length of the orifice 31 as before. The passage 31 and chamber 32 are of approximately similar length.

FIG. 7: The pre-metering insert 33 illustrated here represents a further modification of the metering insert by reason of the type of contoured construction of the face 34 disposed toward the entering stream and which is such as will also effect the non-uniform length of the orifice passage 35, which is continuous through the insert and again omits a separate chamber comparable to the chamber 19 of FIG. 1. The entrance face 34 includes what might be called a middle surface 36 which defines the greatest length of the orifice 35 and upon opposite sides of the plane defined by surface 36 the face of the insert slopes downwardly, as at 37, to the edges of the insert. Thus, the orifice passage 35 is of non-uniform length as represented by the areas of the orifice walls extending to the surface 36 and the varying lengths of the passage walls defined by the sloping edges at the entrance of the passage. This length will vary continuously from the maximum length represented by the surface 36 to the minimums at the lowest points of the edge surface around the entrance of the orifice.

FIG. 8: A modification of the type of pre-metering insert just described is revealed by this form of insert in that the main difference in this structure lies in the sloping surface 38 of the face of the insert disposed toward the entering stream. The surface 38 is disposed in a single sloping plane extending across the full diameter of the insert so that the walls of the orifice 39 are of continuously non-uniform length around the orifice because of meeting the sloping surface 38 at the continuous varying points indicated. The orifice passage 39 in this form is similar to that of FIG. 7 in that the passage is of uniform diameter throughout its length without an enlarged chamber comparable to the chamber 19 of FIG. 1.

Figure 9:
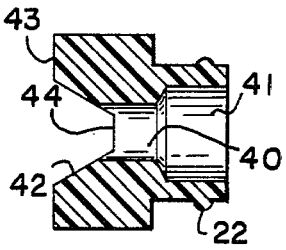

FIG. 9: This arrangement of the pre-metering insert is similar to the insert shown in FIG. 6 in that the orifice passage 40 and chamber 41 are of approximately similar length. The distinction over the previously described arrangement is found in the formation of the groove 42 intersecting the orifice 40 at the face 43 of the insert disposed toward the upstream side. This groove is generally V-shaped but is provided with a widened valley portion 44. This arrangement, of course, provides a non-uniform orifice length just as in all of the previous forms described.

Figure 10:
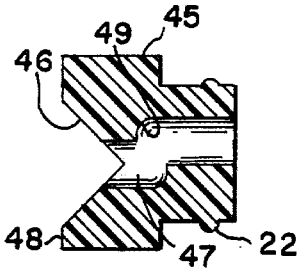

FIG. 10: This insert 45 is generally similar to the FIG. 1 type of pre-metering insert in that it is provided with a V-shaped groove 46 intersecting the orifice passage 47 across the entrance face 48 of the insert to provide the non-uniform orifice characteristic of all of the several species disclosed herein. The distinguishing feature in this form resides in the irregular orifice incorporated in the design by the provision of an offset 49 within the length of the orifice whereby the orifice center lines are disposed off center, the entrance is off center or the discharge opening may be off center so that it functions to increase the turbulence of the issuing stream and discharges the stream into the turbulence chamber 12 from the off center position further to increase the turbulence in the chamber 12.

Figure 11:
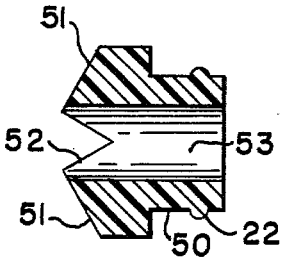

FIG. 11: This insert 50 is similar to the insert 34 of FIG. 7 in the provision of oppositely sloping faces 51 on the end surface of the pre-metering insert disposed toward the entering stream. However, in this arrangement a V-shaped groove 52 intersects the entrance opening of the orifice 53 to provide the non-uniformity of orifice passage found in all forms of the invention disclosed herein.

Figure 12:
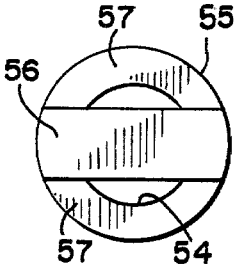
FIGS. 12, 13 and 14 are end elevational and transverse sectional views at 90° from each other through a further modified form of the invention.
Figure 13:
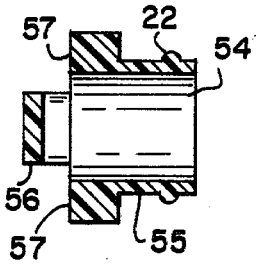
Figure 14:
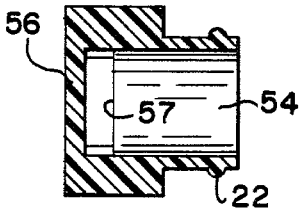

FIGS. 12, 13 and 14: This arrangement achieves the non-uniform orifice length of the passage 54 by the arrangement and structure of the entering end of the pre-metering unit 55 which faces the incoming stream. The orifice passage 54 is of uniform diameter through the unit and a transverse bridge member 56 overlies and intersects the entrance opening of the orifice passage 54 so that the entering stream passes to each side of this bridge in passing into the orifice 54 and in so doing results in the non-uniform length of the orifice traversed by the stream because that portion of the stream passing over the bridge 56 must travel a greater length than the portion of the stream passing over the end portions 57.

CONCLUSION

From the foregoing, it will be seen that a spray nozzle and pre-metering orifice insert have been provided which acts as a restriction to a stream flow and wherein a fluid stream issuing from the pre-orifice into the nozzle is caused to assume a flared out configuration and impinge on the interior side walls of the nozzle and create sufficient turbulence to cause the nozzle to be flooded and provide a spray pattern discharged from the nozzle in accordance with a predetermined specification for the spray. The pre-metering insert includes a non-uniform orifice length that enables the unit to be installed immediately in advance of the nozzle without the necessity for any intervening piping and which reduces the velocity of the stream without disturbing the spray pattern and thereby improve the spraying performance of the nozzle.

The non-uniformity of the orifice is obtained preferably by the provision of a transverse slot on the face of the insert disposed toward the incoming stream and intersecting the entrance opening of the pre-metering orifice in all of the several forms of the nozzle and pre-metering insert. The parts are made of a plastic material from the group including nylon, which is suitably adapted for a device of this type and the service in which it is used, being resistant to the erosive action of insecticides or other chemicals with which the spray nozzle and pre-metering orifice might be used. This nozzle therefore affords advantages over the prior metal nozzles, particularly similar nozzles made of brass.

What is claimed is:

1. A spray nozzle and pre-metering orifice insert made of a plastic material from the group including nylon comprising a nozzle having a turbulence chamber therein and a discharge orifice, a separate pre-metering orifice member of non-uniform length secured in the nozzle and discharging directly into said turbulence chamber, said orifice member having an opening and a central passage therethrough, and means intersecting the opening to said passage at the upstream side of the orifice member, comprising a formed slot of fixed size and shape on the upstream side of the orifice member disposed transversely of the member.

2. A spray nozzle and pre-metering orifice insert as set forth in claim 1 wherein said slot is V-shaped and extends across said upstream side of the orifice member.

3. A spray nozzle and pre-metering orifice insert as set forth in claim 2 wherein said V-shaped slot has a wide valley portion.

4. A spray nozzle and pre-metering orifice insert as set forth in claim 2 wherein said opening has an inwardly conical portion and said V-shaped slot intersects said conical portion.

5. A spray nozzle and pre-metering orifice insert as set forth in claim 2 wherein said central passage is offset whereby the passage discharges into said turbulence chamber from an off-center position.

6. A spray nozzle and pre-metering orifice insert as set forth in claim 1 wherein said slot is concave across the upstream side of the orifice member.

7. In a spray nozzle from which a spray pattern emerges in accordance with a generally laterally directed discharge path, a separate pre-metering orifice insert made from erosion resistant material mounted in the nozzle directly ahead of such discharge path, said orifice insert having a central passage and means intersecting the passage on the upstream face of the insert adapted to create turbulence in the nozzle.

8. A spray nozzle and pre-metering orifice insert as set forth in claim 7 wherein said means intersecting said passage comprises a sloping surface on a face of the insert at the upstream side of the orifice insert.

9. A spray nozzle and pre-metering orifice insert as set forth in claim 8 wherein said sloping surface has oppositely inclined portions from a high point adjacent the center portion of said passage.

10. A spray nozzle and pre-metering orifice insert as set forth in claim 8 wherein said sloping surface has oppositely inclined portions from adjacent the center portion of said passage and a V-shaped slot of fixed size and shape intersecting said center portion.

11. A spray nozzle and pre-metering orifice insert as set forth in claim 7 wherein said means intersecting said passage comprises a fixed bridge overlying said passage and formed integrally with said orifice insert.

* * * * *